US007484567B2

(12) United States Patent
Demange et al.

(10) Patent No.: US 7,484,567 B2
(45) **Date of Patent: *Feb. 3, 2009**

(54) APPLYING SOLID CARBON DIOXIDE TO A HAZARDOUS MATERIAL OR FIRE

(75) Inventors: Albert F. Demange, Fountain Hills, AZ (US); Christoper J. Noël, Goodyear, AZ (US); Gerald P. Zeilhofer, Fountain Hills, AZ (US)

(73) Assignee: Cryo Response, Inc., Fountain Hills, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/925,653

(22) Filed: Oct. 26, 2007

(65) Prior Publication Data

US 2008/0053666 A1 Mar. 6, 2008

Related U.S. Application Data

(63) Continuation-in-part of application No. 11/542,324, filed on Oct. 2, 2006.

(60) Provisional application No. 60/723,049, filed on Oct. 3, 2005.

(51) Int. Cl.
*A62C 2/00* (2006.01)

(52) U.S. Cl. ..... 169/47; 169/24; 169/36; 169/53; 169/54; 169/70; 239/172; 239/654; 62/605

(58) Field of Classification Search ..... 169/24, 169/36, 46, 47, 53, 54, 70; 239/171, 172, 239/654; 62/52.1, 54.1, 605; 134/7, 93; 451/39, 99, 102

See application file for complete search history.

(56) References Cited

U.S. PATENT DOCUMENTS

| | | | | |
|---|---|---|---|---|
| 2,174,606 | A | 1/1939 | Tansill | |
| 2,450,537 | A | 10/1948 | Williamson | |
| 3,070,172 | A | 12/1962 | Carter | |
| 3,933,001 | A | 1/1976 | Muska | |
| 4,038,786 | A | 8/1977 | Fong | |
| 4,617,064 | A | 10/1986 | Moore | |
| 5,355,962 | A | 10/1994 | Anderson et al. | |
| 5,365,699 | A | 11/1994 | Armstrong et al. | |
| 5,368,105 | A | 11/1994 | Chaiken et al. | |
| 5,445,553 | A | 8/1995 | Cryer et al. | |
| 5,632,150 | A | 5/1997 | Henzler | |
| 5,764,716 | A | 6/1998 | Eckardt | |
| 6,145,599 | A | 11/2000 | Mumme | |
| 6,840,331 | B2 | 1/2005 | Sant'Angelo | |
| 6,890,246 | B2 * | 5/2005 | Yamaharu | 451/99 |
| 7,083,000 | B2 | 8/2006 | Edwards et al. | |
| 7,124,833 | B2 | 10/2006 | Sant'Angelo | |
| 2003/0006047 | A1 | 1/2003 | Silverstein et al. | |

* cited by examiner

*Primary Examiner*—Steven J Ganey
(74) *Attorney, Agent, or Firm*—Paul B. Heynssens; Jennings, Strouss & Salmon PLC

(57) ABSTRACT

Delivery of pelletized carbon dioxide (dry ice) to a target material such as a hazardous material or a fire from a distance, by projection, spraying, or aerial dropping the pelletized carbon dioxide onto the target material using gravity. Delivery may be made by a mobile apparatus. The types of target material with which the present invention is designed to apply may include, e.g., hydrocarbon material, hazardous material, burning material, and the like. The carbon dioxide may be pelletized to diameters in a size range of about 3 mm to 100 mm.

18 Claims, 10 Drawing Sheets

APPLYING SOLID CARBON DIOXIDE TO A HAZARDOUS MATERIAL OR FIRE

CROSS-REFERENCE TO RELATED APPLICATION

This application is a continuation in part of U.S. patent application Ser. No. 11/542,324, filed Oct. 2, 2006, which claims the benefit of U.S. Provisional Patent Application No. 60/723,049 filed Oct. 3, 2005, the contents of which are hereby incorporated by reference.

TECHNICAL FIELD

This description relates generally to firefighting and hazardous material abatement and more specifically to applying carbon dioxide ("$CO_2$") to a target material, such as a fire, hazardous material, a hydrocarbon material, or some other material that can be effectively treated with dry ice ("solid $CO_2$") to extinguish, or contain the target material such as a fire and/or hazardous material.

BACKGROUND

Carbon dioxide is a colorless gas, which was first recognized in 1577 by Van Helmont who detected it in the by-products of both fermentation and charcoal burning. $CO_2$ is used in solid (dry ice), liquid and gaseous form in a variety of industrial applications such as beverage carbonation, welding and chemicals manufacture. It occurs in the products of combustion of all carbonaceous fuels and can be recovered from them in a variety of ways. $CO_2$ is widely used today as a by-product of synthetic ammonia production, fermentation, lime kiln operations, and from flue gases by absorption processes. $CO_2$ is also a product of animal metabolism and is critically important in the life cycles of both animals and plants. $CO_2$ is present in our earth's atmosphere in small quantities (0.03%, by volume).

Carbon dioxide ($CO_2$) will extinguish fires in almost all combustibles except for a few active metals, metallic salts and substances containing oxygen, i.e., nitrates, chlorates.

The advantages of carbon dioxide gas for fire extinguishing purposes have been long known. As early as 1914, the Bell Telephone Company of Pennsylvania installed a number of seven pound capacity portable $CO_2$ extinguishers for use on electrical wiring and equipment. By the 1920s, automatic systems utilizing carbon dioxide were available. In 1928, work on the NFPA Standard for carbon dioxide extinguishing systems was begun.

Over the years, two methods of applying carbon dioxide have been developed. The first technique is the total flooding application. The total flooding technique consists of filling an enclosure with carbon dioxide vapor to a prescribed concentration. This technique is applicable both for surface-type fires and potential deep-seated fires. For surface-type fires, such as would be expected with liquid fuels, a minimum concentration of 34% carbon dioxide by volume is mandated. Considerable test work has been done with carbon dioxide on liquid fuels and appropriate minimum design concentrations have been arrived at for a large number of common liquid fire hazards. This method of application has limitations in the amount and distance of applied $CO_2$ that can be effectively delivered. This leads to a small, effective coverage area for such application.

For deep-seated type hazards the minimum permitted concentration is 50% carbon dioxide by volume. Fifty percent design concentration is used for hazards involving electrical gear, wiring insulation, motors, and the like. For hazards involving record storage, such as bulk paper, a 65% concentration of carbon dioxide is required. For substances such as fur and bag-house type dust collectors, a 75% concentration of $CO_2$ is mandated. It should be noted that most surface burning and open flaming will stop when the concentration of $CO_2$ in the air reaches about 20% or less. Thus, it should be apparent that a considerable factor of safety is built in to these minimum $CO_2$ concentrations required by the Standard. Flame extinguishment has typically not been considered to be sufficient fire protection by those who developed the $CO_2$ Standard. This is in contrast to the guidelines given in standards for other gaseous extinguishing agents. Some of these standards may mandate agent concentrations which may be sufficient to extinguish open flame but will not produce a truly inert atmosphere.

The other method of application which has been developed for carbon dioxide is referred to as local application. Local application systems are appropriate only for the extinguishment of surface fires in flammable liquids, gases and very shallow solids where the hazard is not enclosed or where the enclosure of the hazard is not sufficient to permit total flooding. Hazards such as dip tanks, quench tanks, spray booths, printing presses, rolling mills, and the like can be successfully protected by a local application type system. In this system, the discharge of $CO_2$ is directed at the localized fire hazard. The entire fire hazard area is then blanketed in $CO_2$ without actually filling the enclosure to a predetermined concentration.

Extinguishers have been considered a first line of defense in fighting fires. Their practical and functional use tends to render them ideal as a means of prevention and protection against all types of fires. However, the common fire extinguisher typically has only a 3-6 foot range and may have both clean-up problems and high costs. Large commercial $CO_2$ foam solutions to fight fires tend to be expensive in more ways than one. Due to cost, effective coverage area, and safety distance requirements, the local application of CO2 may have limitations in proper fire containment and extinguishing.

FIG. 1 shows a fire tetrahedron. The image shown is known to fire fighters as the fire tetrahedron it may be used to better understand the properties of fire and extinguishment techniques.

It is very similar to the fire triangle which does not represent the chemical chain reaction. The fire tetrahedron is based on the components of extinguishing a fire. Each component represents a property of flaming fire; fuel 11, oxygen 12, heat 13, and chemical chain reaction 14. Extinguishment is based upon removing or hindering any one of these properties. The most common property to be removed is heat. Heat is commonly eliminated by using water. Water is used because it absorbs heat extremely well and is cost efficient. During fire operations you may see objects being placed outside a structure. Though this is commonly referred to as salvage operations, it also acts to remove any fuel from the fire. Without the objects exposed to heat there can be no flammable gasses given off to burn. The third property, oxygen, is usually the hardest to remove. Oxygen removal is typically accomplished when a carbon dioxide extinguisher is used on a fire. In more extreme cases explosives may be used on a fire. The explosion will use up the oxygen in the immediate area. Finally, the last property is the chemical chain reaction. This can be considered the reaction of the reducing agent (fuel) with the oxidizing agent (oxygen). An example of an extinguishment method by hindering the chemical chain reaction is Halon or FM200 extinguishers.

With a surface-type fire, that is, a fire which has not heated the fuel to its auto-ignition temperature much beyond the very surface of that fuel, extinguishment is rapid. Such surface fires are usually the case when liquid fuels are involved. Unfortunately, there is no guarantee that all hazards will produce surface fires. In fact, a great many hazards are more likely to produce fires which will penetrate for some depth into the fuel. Such fires are commonly referred to as deep-seated. When dealing with a so-called deep-seated potential, it is necessary not only to remove the oxygen and decrease the gaseous phase of the fuel in the area, but it may be equally important to permit the heat which is built up in the fuel itself to dissipate. If the heat is not dissipated and the inert atmosphere is removed, the fire may very easily re-flash. For such hazards, it is often necessary to reduce the concentration of oxygen and gaseous fuel to a point where not only is the open flaming stopped, but also any smoldering is eliminated. To accomplish this, the concentration of agent should be held for a sufficiently long time to permit adequate dissipation of built-up heat. The NFPA Standard 12 on carbon dioxide systems has long been a leader in prescribing thorough and conservative fire protection.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

The present examples provide for the application and delivery of $CO_2$ to target materials that may include hazardous materials and/or fires. The present examples provide a way of delivering pelletized dry ice to a target material such as hazardous materials and or fires. The examples tend to improve the manner in which the carbon dioxide is delivered to the hazardous materials and or fires and also the effectiveness of the carbon dioxide in extinguishing burning target material and/or containing hazardous material that would otherwise contaminate its environment. Specifically the present examples provide pelletized carbon dioxide, and can deliver the pelletized carbon dioxide onto the target material such as a hazardous material and/or fire from a distance, thus tending to improve the effectiveness of the pelletized carbon dioxide while tending to minimize the exposure and maximize the safety of those who deliver the pelletized carbon dioxide to the hazardous material and/or fire. In addition nitrogen ($N_2$) may be used in alternative examples to aid in the delivery of pelletized $CO_2$ as using it in pumping the pellets may tend to eliminate moisture and aid pumping.

Moreover, according to an example, the manner in which delivery of pelletized carbon dioxide to the hazardous material and/or fire can be provided by a mobile unit, that can be selectively positioned relative to the hazardous material and/or fire. Thus, a source of pelletized carbon dioxide can be selectively positioned relative to the hazardous material and/or fire, and the pelletized carbon dioxide can be delivered from a distance onto the hazardous material and/or fire.

According to the present example, carbon dioxide is applied to a hazardous material and/or fire, by providing pelletized carbon dioxide, and delivering the pelletized carbon dioxide, e.g., by projecting the pelletized carbon dioxide (e.g., by a turret or its equivalent), spraying the pelletized carbon dioxide (e.g., through a hose), hand delivery (e.g., by buckets or shovels), by aerial dropping the pelletized carbon dioxide by use of gravity, or other commonly known delivery methods.

The types of target material with which the present invention is designed to apply the pelletized carbon dioxide may include, e.g., hydrocarbon material, hazardous material, burning material, and other materials that if not contained would otherwise contaminate its environment.

Also, the carbon dioxide may be pelletized to a size range of about 3 mm to 100 mm pellets diameters. This size may improve the manner in which the carbon dioxide is delivered to the hazardous material and/or fire, and also may maximize the effectiveness of the pelletized carbon dioxide in dealing with the hazardous material and/or fire.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

Figure 1:
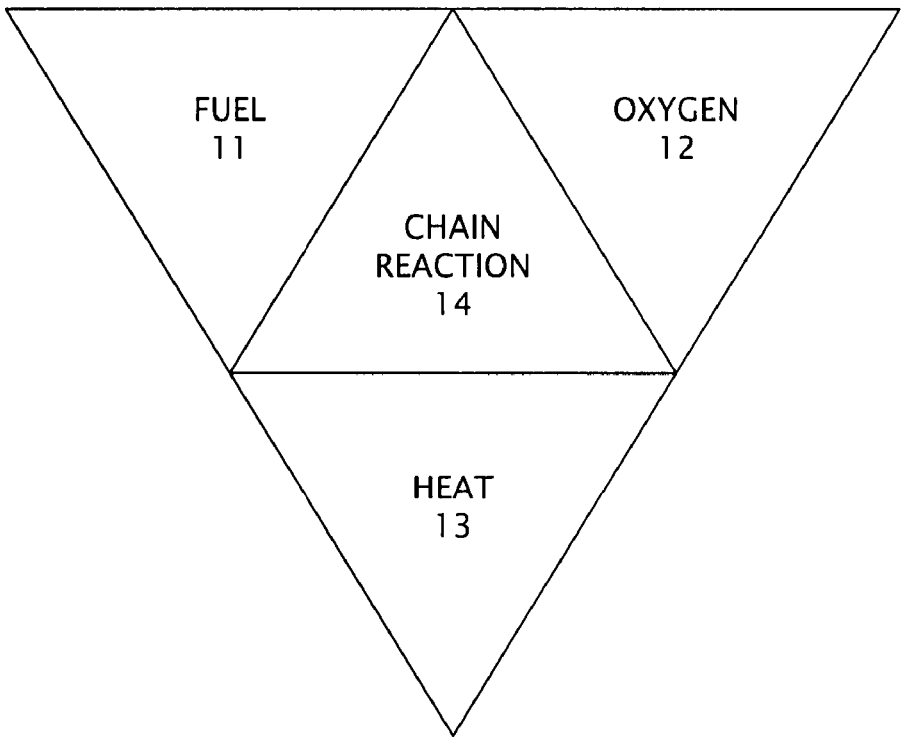
PRIOR ART FIG. 1
FIG. 1 shows a fire tetrahedron.

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

In fire containment and extinguishing, it has been known to apply liquid or gaseous carbon dioxide to the burning material. While the use of liquid or gaseous carbon dioxide to extinguish fires or contain hazardous materials is generally effective, there may be ways in which the delivery and effectiveness of the carbon dioxide can be improved. Specifically, applicant has developed systems and methods in which carbon dioxide may be delivered to a hazardous material and/or fire by pelletizing the carbon dioxide (to "pelletized dry ice", or "pelletized $CO_2$") and providing equipment that can deliver the pelletized dry ice onto the hazardous material and/or fire from a distance, and in sufficient quantity, thus tending to improve the effectiveness of the carbon dioxide, while minimizing the exposure and maximizing safety of those who deliver the carbon dioxide to the hazardous material and/or fire. Moreover, delivery of the pelletized carbon dioxide to the hazardous material and/or fire can be accomplished by a delivery system that tends to be mobile, and can be selectively positioned relative to the hazardous material and/or fire.

As discussed above, the present examples allows delivering solid carbon dioxide ($CO_2$) (i.e., dry ice) to a hazardous material and/or fire. The apparatus may be designed to improve the manner in which the carbon dioxide is delivered to the hazardous material and/or fire, and the effectiveness of the carbon dioxide in dealing with the hazardous material and/or fire. Specifically the present example provides pelletized dry ice and can deliver the pelletized dry ice onto the hazardous material and/or fire from a significant distance, thus minimizing the exposure and maximizing the safety of those who deliver the dry ice to the hazardous material and/or fire.

The principles of the application of pelletized carbon dioxide are described below in connection with two examples of mobile systems for applying pelletized carbon dioxide to a hazardous material and/or fire. However, the application of pelletized carbon dioxide can be achieved with other equivalent. In addition, the following detailed description relates to target material in the form of burning material, or to hazardous materials that need to be contained, but from that description the manner in which the principles of the present invention can be used with other types of target materials will also be apparent to those in the art.

Definitions: In this application, a. The concept of pelletized carbon dioxide being delivered onto a target material such as a fire and/or hazardous material is intended to encompass all ways of delivering the pelletized carbon dioxide onto the hazardous material and/or fire from any distance, including, inter alia, (i) projecting the pelletized carbon dioxide from a distance and onto the hazardous material and/or fire (e.g., with a turret or the like), (ii) spraying the pelletized carbon dioxide from a distance and onto the hazardous material and/or fire (e.g., with a hose or the like), (iii) aerial dropping the pelletized carbon dioxide onto the hazardous material and/or fire (e.g., by allowing it to drop by gravity from a distance onto the hazardous material and/or fire.

b. The concept of spraying or projecting carbon dioxide pellets from an unpredetermined distance means spraying or projecting from a range that may be determined based on (i) the capabilities of the spraying or projection equipment to spray or project at that range, (ii) the effectiveness and coverage of carbon dioxide pellets sprayed or projected from that range, and/or (iii) the safety to the operator of spraying or projecting from that range.

c. The concept of carbon dioxide pellets being in a defined size range means that the pellets may be formed with a goal of the largest quantity across a majority of the pellets (i.e., at least 50% of the pellets) being in that size range. For example, the pellets could be formed by extrusion through dies whose size is designed to produce a majority of pellets in the defined size range.

d. The term hazardous material means a substance that has been designated as hazardous material under Title 49 of the United States Code, e.g., Title 49 section 5103a or equivalent.

Figure 2:
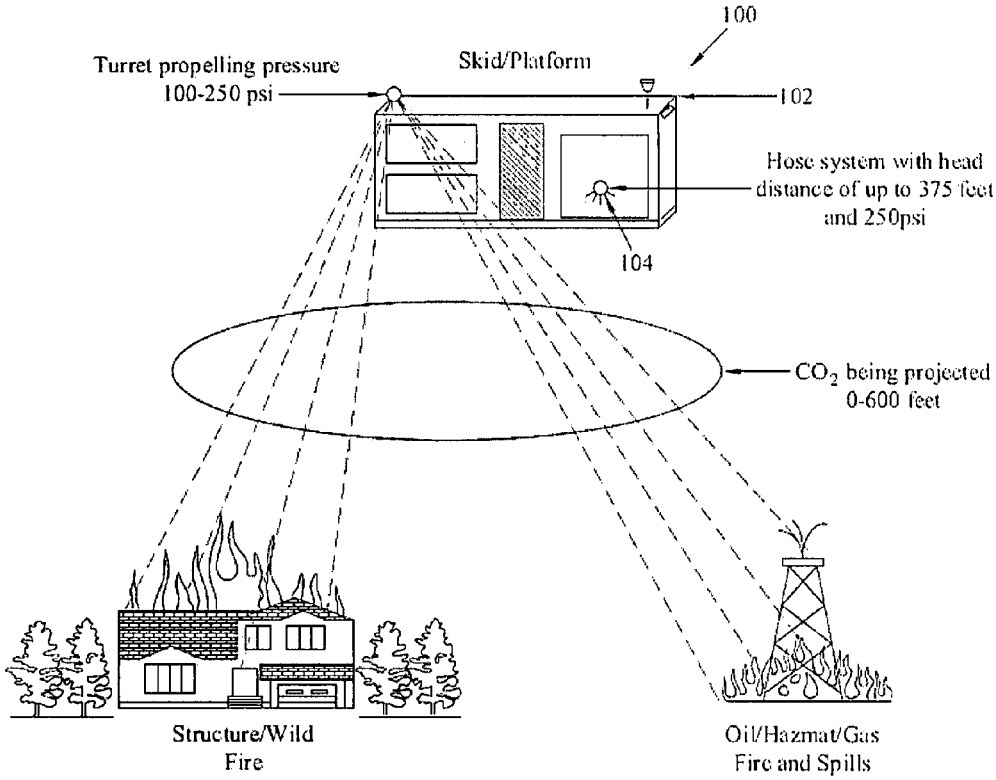
FIG. 2 is an illustration of a system for applying carbon dioxide pellets onto a hazardous material and/or fire.

FIG. 2 is an illustration of one form of system 100 that produces and applies $CO_2$ pellets. The system 100 includes a skid or platform 102 that carries the apparatus for producing carbon dioxide pellets and projecting or spraying the pelletized carbon dioxide onto a fire or to a hazardous material fire or spill. Please note that any numerical ranges provided in the figure are given by way of example only and are not meant to be limiting in any way to the disclosure.

Figure 3:
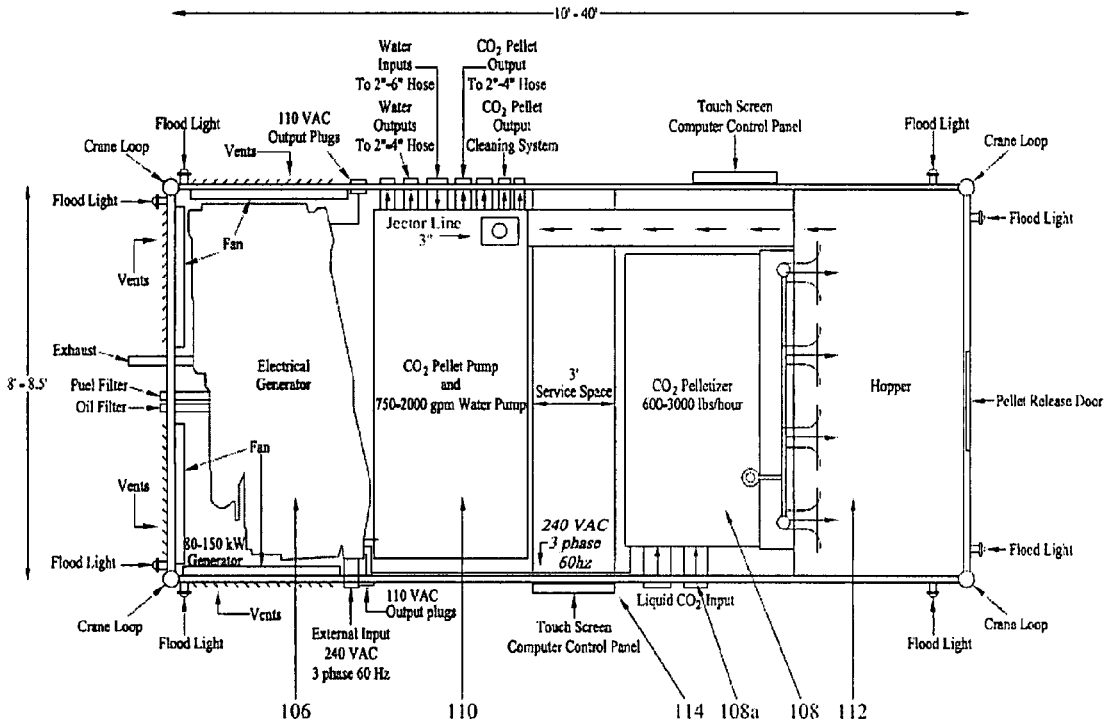
FIG. 3 is an illustration of the components of the system of FIG. 2.

The equipment is shown schematically in FIGS. 2 and 3. A support structure 104 forms a part of the skid/platform (see FIG. 2), and supports the equipment (FIG. 3) that is provided for producing and delivering pelletized carbon dioxide to a fire or a hazardous material. The equipment may include a generator 106, a pelletizer 108, a pellet pump (that can also function as a water pump), or delivery device 110, and a hopper 112. Alternative examples may include one or more air extraction units to extract carbon dioxide and/or nitrogen from the air. The generator 106 provides power for driving the other equipment. In an alternative example an external generator may be used to power the equipment. The pelletizer 108 is configured for connection to a source of liquid carbon dioxide (through inputs 108*a*), and is designed to pelletize the liquid carbon dioxide, typically into pellets of predetermined size range. The hopper 112 is configured to receive pelletized carbon dioxide from the pelletizer 108 and to store the carbon dioxide pellets for application to a hazardous material and/or fire. The pellet pump 110 is connected to the hopper and is configured to draw pelletized carbon dioxide from the hopper and to deliver the pelletized carbon dioxide to a turret or to a spray hose (FIG. 2) to enable the pelletized carbon dioxide to be projected or sprayed onto a hazardous material and/or fire, as described further below.

The pellet pump may be equipped with a nitrogen inlet. The nitrogen supplied to the pump may be in either liquid or gaseous form. Nitrogen may be introduced throughout the process. For example, the hopper may be charged, and the air lines filled with $N_2$ (other plumbing may also be filled with nitrogen) Nitrogen may be used in gaseous form to aid in pumping the pellets. Using nitrogen may eliminate air and the moisture typically contained in air, which may tend to cause jams in the pumping system through condensation and freezing. Alternatively pure nitrogen or a mixture of air and nitrogen may be used to produce satisfactory pumping of the pellets.

FIG. 3 is an illustration of the components of the system of FIG. 2. Please note that any numerical ranges provided in the figure are given by way of example only and are not meant to be limiting in any way to the disclosure. Two forms of carbon dioxide pellet outputs may be provided, one to a typically 2"-4" hose (with a range that can typically range from 1"-2", or greater), and the other to another type of delivery device. In alternative examples a plurality of carbon dioxide pellets outputs may be provided. Thus, the outlet(s) that couple to the typically 2"-4" hose (with a range that can typically range from 1"-2", or greater), may be used to deliver carbon dioxide pellets to a hazardous material and/or fire at one distance, and the other carbon dioxide pellet outlet(s) may be used to deliver the carbon dioxide pellets to a hazardous material and/or fire that is at another distance (e.g., a distance that is closer than the distance requiring delivery through the exemplary 2" hose). The equipment may also include one or more computer control panels 114 that can receive operating inputs from respective touch screens, and control the pelletizing, storing, and delivery of the pelletized carbon dioxide (two computer control panels 114 are typically included, to provide the system with redundancy, in the event of failure of one computer panel). Features of the foregoing components are further illustrated on FIG. 3, and additional features of the equipment, are also shown in FIG. 3. An exemplary pelletizer 108 may be the Model P300 Pelletizer, produced by Cold Jet of 455 Wards Corner Road, Loveland, Ohio, 45104, or its equivalent. An exemplary pellet pump 110 may be the Series 4600 Horizontal Split Case Pump, manufactured by Armstrong Pumps located at 93 East Avenue, North Tonawanda, N.Y., or its equivalent. Exemplary computer controls 114 can be the Model PPC-V106 computer, manufactured by Advantech of 15375 Barranca Parkway, Suite A-106, Irvine, Calif., 92618, or its equivalent.

Figure 4:
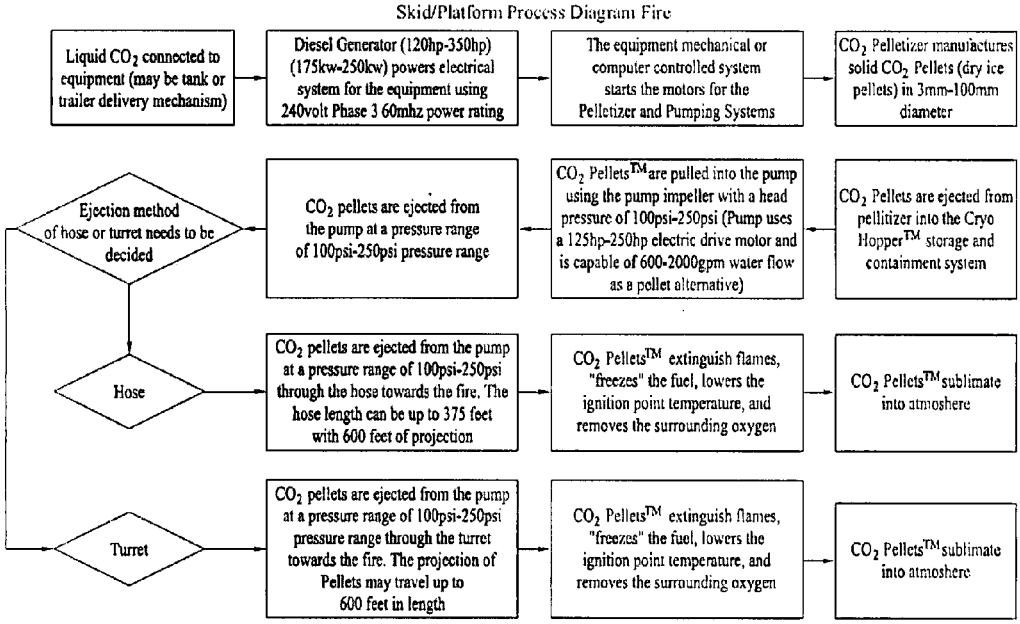
FIG. 4 is a flow chart showing a method of applying carbon dioxide pellets to a target material that is a burning fire, with the system of FIGS. 2-3.
Figure 5:
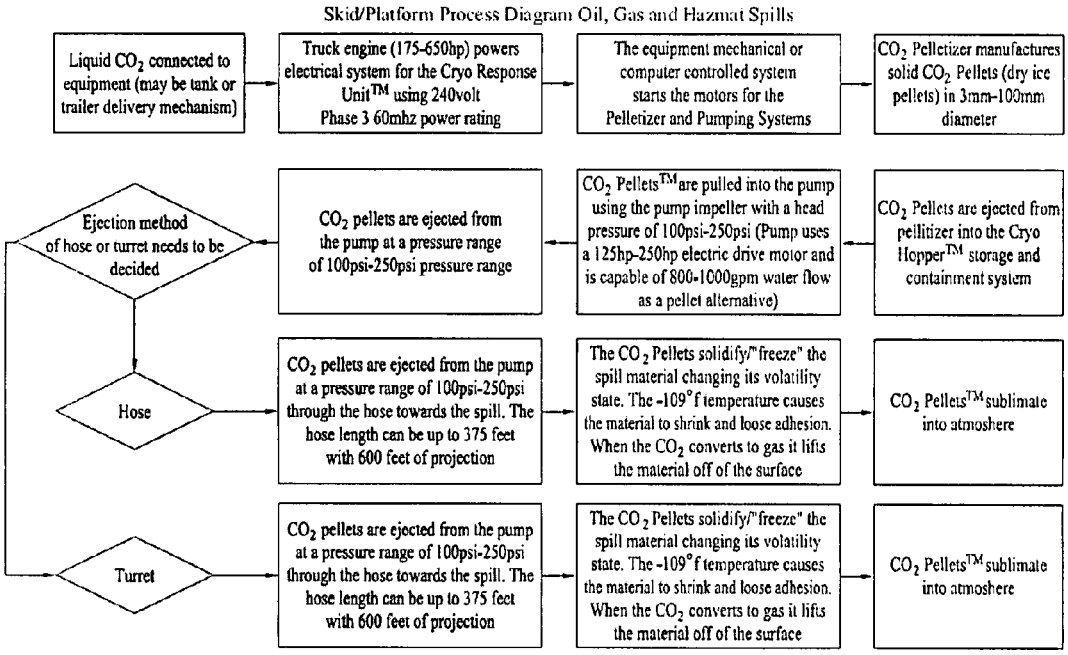
FIG. 5 is a flow chart showing of a method of applying carbon pellets to a target material that is a hazardous material that needs to be contained, with the system of FIGS. 2-3.
Figure 6:
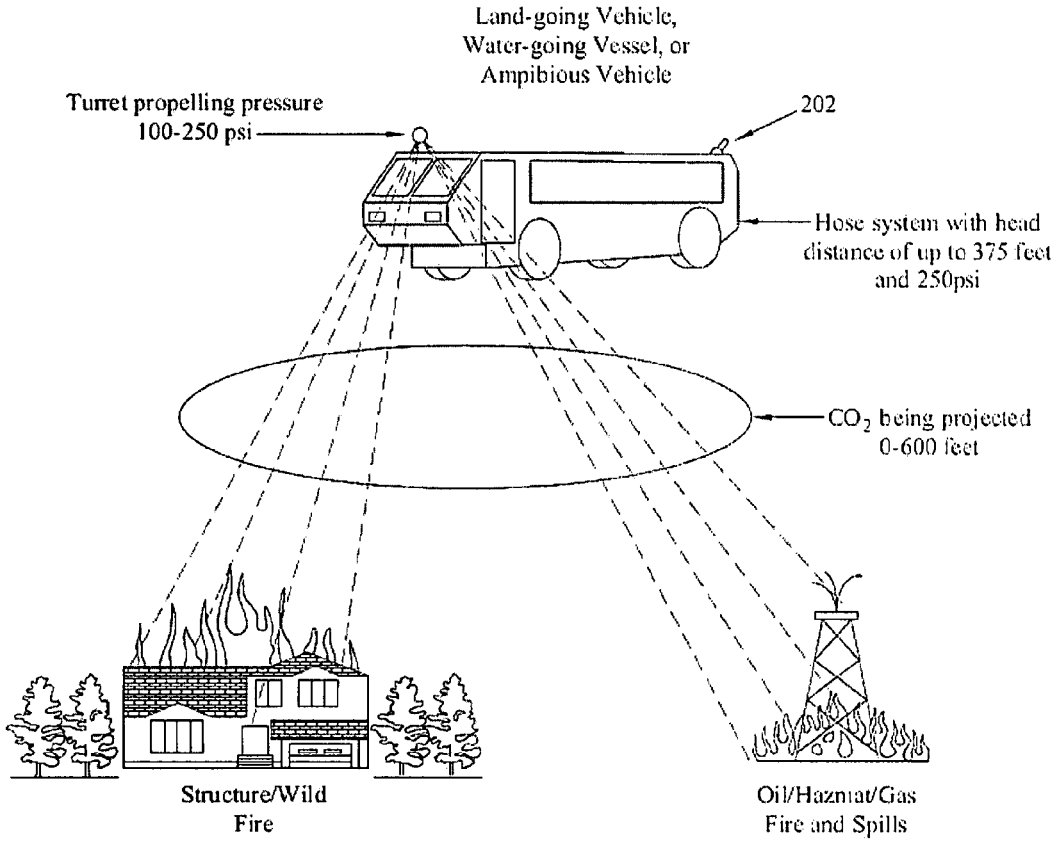
FIG. 6 is an illustration of an alternative system for applying carbon dioxide pellets onto a hazardous material and/or fire.
Figures 6, 7:
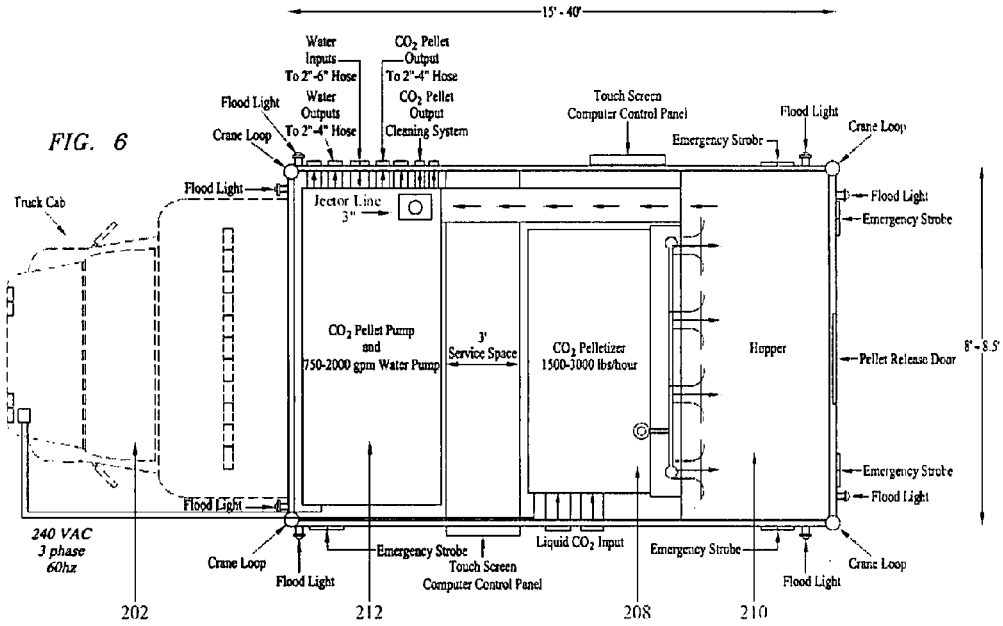
FIG. 7 is an illustration of the components of the system of FIG. 6.
Figure 8:
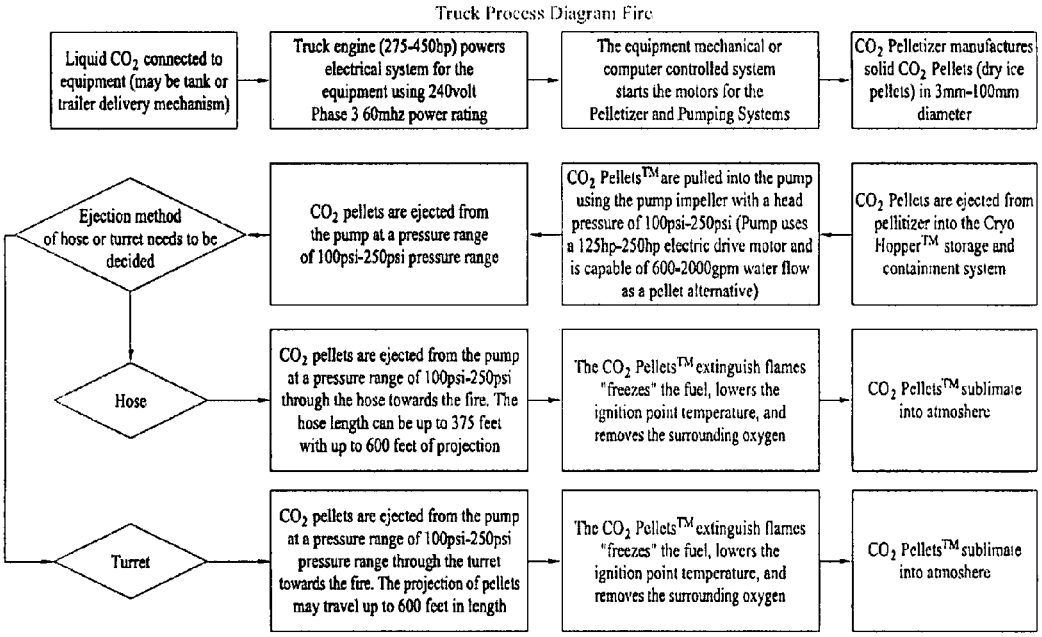
FIG. 8 is a flow chart showing a method of applying carbon dioxide pellets to a hazardous material and/or fire, with the system of FIGS. 6-7.
Figure 9:
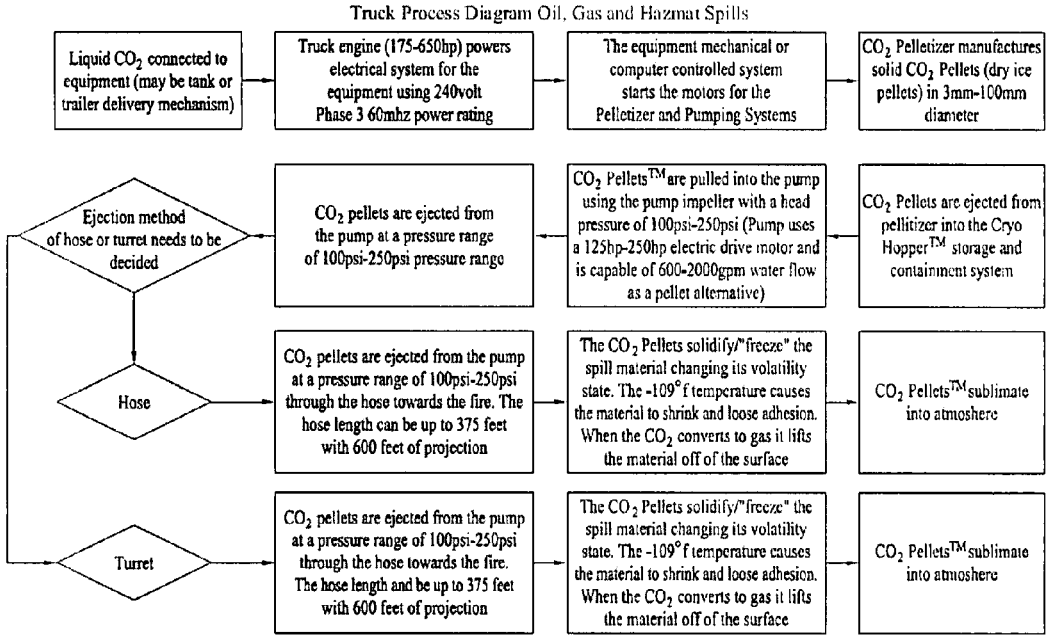
FIG. 9 is a flow chart showing a method of applying carbon dioxide pellets to a target material that is a hazardous material that needs to be contained, with the system of FIGS. 6-7.

FIGS. 4 and 5 illustrate the manner in which pelletized carbon dioxide is delivered, e.g., projected or sprayed onto a fire or a hazardous material that needs to be contained. Please note that any numerical ranges provided in the figure are given by way of example only and are not meant to be limiting in any way to the disclosure. The figures also show additional features of the equipment. In the implementation of the method, the equipment e.g., the skid/platform 102 carrying the equipment, may be positioned relative to the hazardous material and/or fire, so that the pelletized carbon dioxide can be effectively projected or sprayed onto the hazardous material and/or fire, from a distance and orientation that is predetermined by the location and orientation of the skid/platform 102 relative to the hazardous material and/or fire. For example, the skid/platform 102 can be maneuvered by an overhead crane relative to the hazardous material and/or fire (crane loops 116 are provided on the skid/platform for that purpose). The skid/platform can be supported on a vehicle that enables the skid/platform 102 to be maneuvered relative to the hazardous material and/or fire, or otherwise positioned.

The source of liquid carbon dioxide is connected to the equipment, e.g., via the liquid carbon dioxide inputs 108*a* on the pelletizer 108. The source of liquid carbon dioxide may be, e.g., a tank or a trailer delivery device that may be included in the skid/platform or may be external to the skid/platform. The equipment may be powered by generator 106, e.g., an exemplary 120 hp-550 hp Diesel Generator, with a 240 volt 3 phase 60 Hz power rating, or an equivalent power source. The computer 114 starts the motors for the pelletizer 108 and the pellet pump 110. The pelletizer 108 is configured to produce solid carbon dioxide (dry ice) pellets in a predetermined size range (for example in 3 mm to 100 mm diameter range). The carbon dioxide pellets are then ejected from the pelletizer into the hopper 112, or into some other storage and containment device. The carbon dioxide pellets are drawn into the pump 110 by an impeller or equivalent method, e.g., under a head pressure of about 100 psi-250 psi, (the exemplary pump 110 may uses an exemplary 125 hp-250 hp electric drive motor and has the capability to produce an exemplary 200-2000 gpm or greater water flow as a pellet alternative). The carbon dioxide pellets are delivered from the pump 110, e.g., in an exemplary pressure range of 100 psi-180 psi. The ranges given in the paragraph above or exemplary other ranges may be utilized to provide similar or equivalent results.

As mentioned above the water pump is an impeller centrifugal or equivalent pump to produce a desired flow capacity or capacities. The pump may be switched over through the control panel, or other equivalent method, to pump water rather than carbon dioxide pellets. Switching may be through a manually actuated valve. however actuation by the control panel may be easily accomplished since the panel is touch sensitive and actuation can be accomplished even while wearing heavy gloves. Thus if a change in fire fighting or spill abatement tactics are needed the same equipment that provides carbon dioxide pellets may also be configured to switch to pumping water, supplied by an appropriate conventionally constructed water inlet and switching hardware included in the construction of the equipment.

As further illustrated by FIGS. 4 and 5, the method by which the carbon dioxide pellets are delivered to the hazardous material and/or fire may be by a hose (sprayed), by a turret method (projected), or gravity dropped from any type of aircraft. Dropping may be assisted or unassisted where assisted may use mechanical pneumatic or hydraulic methods to expel the pellets. Please note that any numerical ranges provided in the figure are given by way of example only and are not meant to be limiting in any way to the disclosure. With the hose method, the carbon dioxide pellets are delivered from the pump 110, e.g., in a typical pressure range of 100 psi-180 psi, through a hose and sprayed through the hose toward the hazardous material and/or fire. In the case of a fire, for example, the hose length could be up to 375 feet with the capability to deliver the pellets up to and additional 600 feet or more past the head of the hose. With the turret method, the carbon dioxide pellets may be delivered from the pump and ejected (projected) from a turret, e.g., in a pressure range of typically 100 psi-250 psi, with a projection range from the turret of up to around 500 feet or more. The exemplary pressure listed here may be increased accordingly if a moderate or high pressure system is constructed.

With either delivery method, when used to extinguish a fire, the pellets will extinguish the fire, by extinguishing the flames, effectively "freezing" the fuel (i.e., the material that is fueling the fire), lowering the temperature of the burning material, and removing the surrounding oxygen. The carbon dioxide pellets will then sublimate into the atmosphere. When used to contain a hazardous material spill that is on a surface (e.g., the surface of a body of water), the carbon dioxide pellets solidify/"freeze" the spill material, thereby changing its volatility state. The low temperature of the carbon dioxide pellets (e.g., typically about −109° F.) typically causes the hazardous material to shrink and lose adhesion. When the carbon dioxide sublimates into the atmosphere as a gas, it tends to lift the hazardous material off the surface.

FIGS. 6-9 illustrate how the principles of the present examples can be applied to equipment that is supported on a land-going vehicle, water-going vessel, amphibious truck vehicle, or equivalent, 202, rather than a skid/platform. Please note that any numerical ranges provided in the figure are given by way of example only and are not meant to be limiting in any way to the disclosure. In a further alternative example an aircraft may be used to pump pre-made pellets from the air by the methods previously described. In this example an air extraction unit that typically can extract $N_2$ or other gases from the atmosphere or ambient atmosphere may also be provided as an alternative example. The equipment would still include a carbon dioxide pelletizer 208, hopper 210 and pellet pump 212 that are essentially similar to the pelletizer, hopper and pellet pump of the examples of FIGS. 2-5. The power source could be the truck vehicle or vessel engine (e.g., a 175-650 hp diesel or gasoline engine, using a 240 volt 3 phase 60 Hz power rating), or other convenient source.

In all other respects, the equipment of FIGS. 6-9, and the method by which the equipment is operated to project carbon dioxide pellets at a fire or a hazardous material spill, may be essentially the same as that shown and described FIGS. 2-5.

While the foregoing description relates to delivering the pelletized carbon dioxide by projection or by spraying, other ways of delivering pelletized carbon dioxide to a fire, hazardous material, hydrocarbon, or other material that if not contained could contaminate its environment are contemplated. For example, it is contemplated that in alternative examples the pelletized carbon dioxide could be delivered to a hazardous material and/or fire, from a distance, by aerial drop 302, so that the pelletized carbon dioxide is dropped from an aircraft and falls by gravity onto the hazardous material and/or fire. The carbon dioxide would be pelletized, and then stored on the aircraft and dropped from the aircraft, using the type of techniques that are conventionally used in fighting forest fires.

A further alternative example provides an in building system configured to deliver pellets to a fire or hazardous material spill. By delivering carbon dioxide to a nozzle at a high pressure at room temperature (or equivalently low pressure at low temperature) a temperature drop produced may cause the carbon dioxide to solidify producing the effect previously described to extinguish a fire or contain a hazardous material spill.

In any event, irrespective of the manner of delivery, it is noted that the carbon dioxide be in the 3 mm to 100 mm size range. That size range may be designed to optimize the (i) amount and density of the pelletized carbon dioxide that is delivered to the hazardous material and/or fire, (ii) coverage area, and (iii) effectiveness of the carbon dioxide delivered to the hazardous material and/or fire. That size range may be particularly effective when the pelletized carbon dioxide is projected or sprayed onto the hazardous material and/or fire, since the effectiveness of the pelletized carbon dioxide is largely a function of pellet size, distance (projected or sprayed) and the coverage provided by the pelletized carbon dioxide. Moreover, it is believed useful to restate the manner in which the pelletized carbon dioxide deals with a target material such as a fire, or hazardous material that may be burning. The pelletized carbon dioxide (i) "freezes" the fuel, dropping ignition point temperature, (ii) displaces the oxygen, with the carbon dioxide, extinguishing the open burning, (iii) dissipates heat due to the −109° F. temperature of the carbon dioxide, and (iv) by "freezing" the fuel and displacing the oxygen, the eliminates the chemical reaction that fuels the fire.

In using the examples described above the resulting environmental cleanup time and costs may be reduced compared to current conventional and acceptable techniques. An additional benefit may be the resulting reduction in economic and/or environmental damage because of the speed at which the hazardous material and/or fires become controlled and/or contained compared to current and acceptable ways and techniques known by the art. Another benefit may be the reduced risk of exposure to the hazardous material and/or fire(s) and the increase in safety because of the further distance from the hazardous material and/or fire(s) that those delivering the pelletized carbon dioxide can be compared to current conventional and acceptable techniques.

In the case of a fire for a target material, it may be known that according to the Fire Tetrahedron, all fires have four core components: fuel, oxygen, heat and a resulting chemical reaction. The examples described may attack the components of the fire tetrahedron as follows:

1. FUEL The carbon dioxide pellets "freeze" the fuel, dropping the substance temperature below its ignition point. The carbon dioxide pellets are −109° F.
2. OXYGEN The carbon dioxide pellets displace the oxygen with the $CO_2$, extinguishing the open burning.
3. HEAT The carbon dioxide pellets dissipate heat due to their −109° F. temperature
4. CHEMICAL REACTION The carbon dioxide pellets "freeze" the fuel and displace the oxygen eliminating the chemical reaction. The $CO_2$ is heavier than oxygen.

In the case of a HazMat (hazardous material as defined pursuant to title 49 of the United States code) the two issues are typically containment and cleanup. A result of applying the examples described may be:

1. CONTAINMENT The carbon dioxide pellets "freeze" the HazMat spill, causing the target material which may be a hazardous material that may also be burning to solidify and stop spreading.
2. CLEANUP The carbon dioxide pellets cause liquids to shrink and lose adhesion. The pellets expand when they convert back to a gaseous state, causing the target material such as a hazardous material to lift of the surface for much easier and cost effective cleanup.

Figure 10:
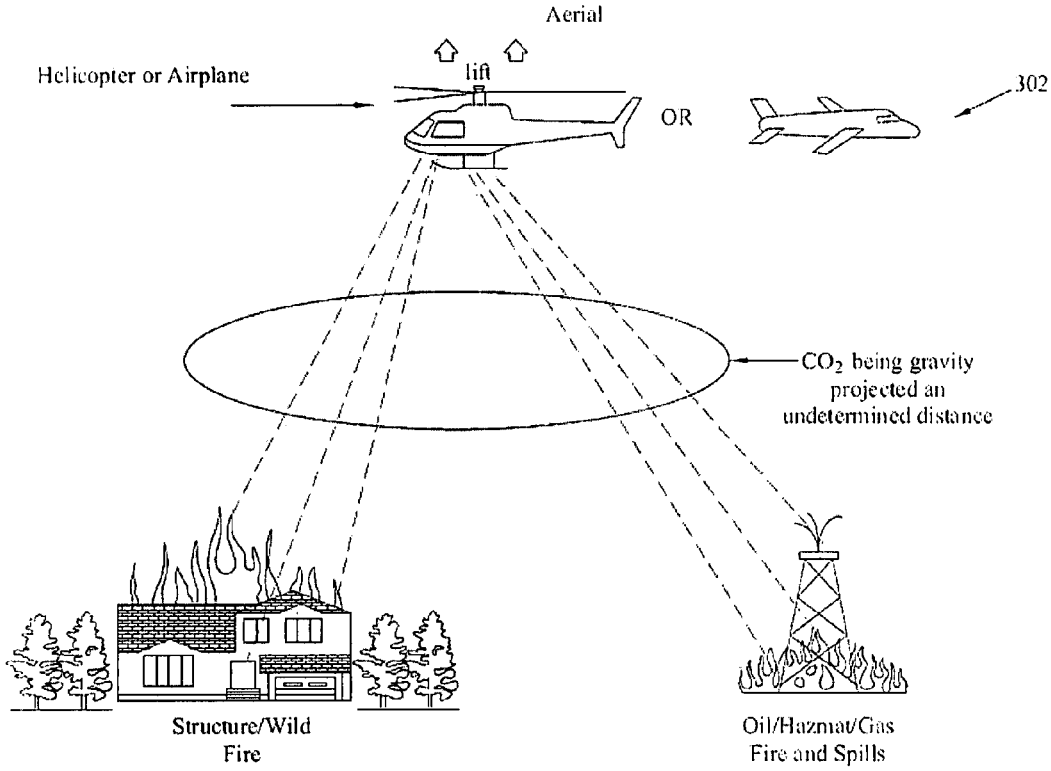
FIG. 10 is an illustration of a further alternative system for applying carbon dioxide pellets onto a hazardous material and/or fire.

FIG. 10 is an illustration of a further alternative system for applying carbon dioxide pellets onto a hazardous material and/or fire. Pellets may be dispensed from a helicopter or aircraft to contain a hazardous material or to extinguish a fire. The pellets may be dispensed from a hopper, or dispensed as they are formed. In dispensing the pellets they may be dropped by gravity and or assisted by ejecting them by pneumatic, hydraulic, and/or mechanical methods.

It is also worth noting that the application of palletized carbon dioxide may be used to plug a fuel leak such as fuel oil, gasoline, crude oil, hazardous material and the like. The pellets may be applied to a leak to freeze the material forming a plug that can last until patching or transfer can be achieved. Delivery can be by a chute, projection or other methods that can rely on gravity or mechanical, hydraulic, pneumatic forces to assist in delivering the pellets to the leak to be sealed.

Thus, as seen by the foregoing detailed description, providing carbon dioxide in pellet form and projecting or spraying carbon dioxide pellets or aerial dropping by gravity onto the hazardous material and/or fire from an un-predetermined distance may be accomplished. The target material may include but is not limited to, e.g., hydrocarbon material, hazardous material, a burning material, a combination of hazardous material that is burning, and other material that if not contained could otherwise contaminate its environment. The pelletized carbon dioxide that is projected, sprayed or dropped onto the hazardous material and/or fire may be in a size range of about 3 mm to 100 mm. Additionally, the equipment may be supported (e.g., by support structure that can comprise one or more support members) in a manner that enables the equipment to be maneuvered relative to the hazardous material and/or fire and enables pelletized carbon dioxide to be projected, or sprayed, or dropped using gravity from an un-predetermined distance onto the hazardous material and/or fire.

The invention claimed is:

1. A method of fire and or hazardous material abatement by applying carbon dioxide ($CO_2$) in a solid state to a fire and/or hazardous material, comprising pelletizing carbon dioxide into a plurality of solid, uncoated carbon dioxide pellets form, from 3 mm to 100 mm in diameter; and delivering the plurality of solid uncoated carbon dioxide pellets from 3 mm to 100 mm in diameter onto the-fire and/or hazardous material.

2. The method of claim 1, wherein delivering the plurality of solid uncoated carbon dioxide pellets onto the fire and/or hazardous material is by a nozzle.

3. The method of claim 1, further comprising storing the plurality of solid uncoated carbon dioxide pellets in a hopper.

4. The method of claim 1, wherein delivering plurality of solid uncoated carbon dioxide pellets is aided with a nitrogen stream.

5. The method of claim 4, wherein the nitrogen stream is applied in sufficient quantity such that moisture does not interfere with delivery of the plurality of solid uncoated carbon dioxide pellets.

6. The method of claim 1, wherein delivering plurality of solid uncoated carbon dioxide in pellets is performed from a support structure, disposed a predetermined distance from the fire and/or hazardous material.

7. The method of claim 6, wherein delivering the plurality of solid uncoated carbon dioxide pellets onto the fire and/or hazardous material is by spraying.

8. The method of claim 6, wherein the support structure is a vehicle.

9. The method of claim 6, wherein delivering the plurality of solid uncoated carbon dioxide pellets is accomplished by dropping the plurality of solid uncoated carbon dioxide pellets by gravity onto the fire and/or hazardous material.

10. The method of claim 1, wherein pelletizing the carbon dioxide pellets is performed by extruding liquid carbon dioxide into pellet form.

11. A fire and/or hazardous material abatement support structure comprising:

a pelletizer forming solid uncoated carbon dioxide from 3 mm to 100 mm in diameter pellets disposed on the fire and/or hazardous material abatement support structure and configured for connection to a source of liquid carbon dioxide;

a delivery device disposed on the fire and/or hazardous material abatement support structure projecting or spraying the solid uncoated carbon dioxide from 3 mm to 100 mm in diameter onto a fire and/or hazardous material pellets.

12. The support structure for applying carbon dioxide to a fire and/or hazardous material of claim 11, further comprising a storage device disposed on the support structure for storing the solid uncoated carbon dioxide pellets.

13. The support structure of claim 11, wherein the support structure is portable such that the delivery device can project or spray the solid uncoated carbon dioxide pellets onto the fire and/or hazardous material.

14. The support structure of claim 11, wherein the support structure is disposed on a moveable vehicle.

15. The support structure of claim 13, wherein the carbon dioxide processing equipment is powered by a generator carried by the moveable vehicle.

16. The support structure of claim 11, wherein the source of liquid carbon dioxide is an air extraction unit.

17. A fire and or hazardous material abatement method of applying solid carbon dioxide pellets from 3 mm to 100 mm in diameter to extinguish a fire and/or hazardous material comprising:

pelletizing carbon dioxide into solid uncoated carbon dioxide pellets from 3 mm to 100 mm in diameter;

storing the solid uncoated carbon dioxide pellets from 3 mm to 100 mm in diameter in a storage bin;

mixing the solid uncoated carbon dioxide pellets from 3 mm to 100 mm in diameter with nitrogen prior to projecting or spraying the solid uncoated carbon dioxide pellets; and pumping the solid uncoated carbon dioxide pellets from 3 mm to 100 mm in diameter from the storage bin onto the fire and or hazardous material.

18. A fire and or hazardous material abatement method of abating a fire or a hazardous material spill by an application of a plurality of solid uncoated carbon dioxide pellets from 3 mm to 100 mm in diameter comprising:

pelletizing carbon dioxide into the plurality of solid uncoated carbon dioxide pellets from 3 mm to 100 mm in diameter;

applying the plurality of solid uncoated carbon dioxide pellets from 3 mm to 100 mm in diameter to the fire or hazardous material spill;

freezing the hazardous material or a fuel to the fire by the application of the plurality of solid uncoated carbon dioxide pellets from 3 mm to 100 mm in diameter;

lowering an ambient temperature by the application of the plurality of solid uncoated carbon dioxide pellets from 3 mm to 100 mm in diameter; and removing surrounding oxygen, in which freezing caused by the plurality of solid uncoated carbon dioxide pellets causes the hazardous material to shrink and lift off of a surface, and in which a chemical reaction fueling the fire is eliminated by freezing.

* * * * *